US007556163B2

(12) United States Patent
Brant

(10) Patent No.: US 7,556,163 B2
(45) Date of Patent: Jul. 7, 2009

(54) LIGHTENED, MOLDED PLASTIC CLOSURE EXHIBITING ENHANCED STRENGTH

(75) Inventor: Jeff Brant, Crawfordsville, IN (US)

(73) Assignee: Alcoa Closure Systems International, Inc., Crawfordsville, IN (US)

( * ) Notice: Subject to any disclaimer, the term of this patent is extended or adjusted under 35 U.S.C. 154(b) by 120 days.

(21) Appl. No.: 11/509,523

(22) Filed: Aug. 24, 2006

(65) Prior Publication Data

US 2008/0073313 A1 Mar. 27, 2008

(51) Int. Cl.
*B65D 41/04* (2006.01)

(52) U.S. Cl. ..... 215/329; 215/305; 220/288

(58) Field of Classification Search ..... 215/329, 215/295, 305; 220/288
See application file for complete search history.

(56) References Cited

U.S. PATENT DOCUMENTS 2,597,830 A * 5/1952 Webb ..... 53/487
4,317,526 A * 3/1982 Plitz ..... 215/217
4,497,765 A * 2/1985 Wilde et al. ..... 264/268

FOREIGN PATENT DOCUMENTS

DE 3233806 A1 * 3/1984

* cited by examiner

*Primary Examiner*—Robin Hylton
(74) *Attorney, Agent, or Firm*—Wood, Phillips, Katz, Clark & Mortimer

(57) ABSTRACT

A lightened, molded plastic closure exhibiting enhanced strength includes a top wall portion, and an internally threaded, depending annular skirt portion. The interior surface of the skirt portion, below the closure thread, defines an array of alternating grooves and lands, which together define a plurality of circumferentially spaced, vertically extending strengthening ribs on the inside surface of the skirt portion. The skirt portion thus exhibits desirably enhanced column strength, thereby facilitating efficient formation by "stripping" from an associated core pin during molding. In the preferred form, the exterior surface of the skirt portion is provided with a plurality of circumferentially spaced gripping knurls respectively aligned with the grooves defined at the interior surface of the skirt portion.

7 Claims, 2 Drawing Sheets

LIGHTENED, MOLDED PLASTIC CLOSURE EXHIBITING ENHANCED STRENGTH

TECHNICAL FIELD

The present invention relates generally to plastic closures molded from polymeric material, and more particularly to a molded plastic closure, which can be sized in a relatively wide diameter, and configured to conserve use of plastic material, while exhibiting requisite closure strength.

BACKGROUND OF THE INVENTION

Plastic closures molded from polymeric material, such as polypropylene and polyethylene, find widespread application for use in association with containers having beverages and food products. For some applications, such as for containers for food products for which ready access is desirable, relatively large-diameter closures, which may have diameters on the order of 63 to 110 millimeters, are desirably employed.

Typically, closures of this nature do not include an integral tamper-indicating pilfer band or the like, but instead typically include an internally-threaded annular skirt portion which terminates in a free edge. In the past, the portion of the skirt below the thread formation, which enhances the visual appeal of the closure and facilitates gripping by consumers, has been made heavier, and thus more costly, than is typically required for the closure to function as desired. However, this lower skirt portion is preferably configured to exhibit sufficient strength to facilitate "stripping" of the closure from an associated internal core pin, that is, effecting removal of the closure from the core pin without resort to a collapsible core, or a relative unthreading motion of the closure.

The present invention provides a molded plastic closure exhibiting enhanced column strength, which facilitates efficient formation by permitting stripping from an associated core pin during molding, without resort to a relatively complex collapsible core. At the same time, the closure desirably requires the use of less plastic material while still exhibiting the desired strength, thus further facilitating cost-effective formation and use.

SUMMARY OF THE INVENTION

The present invention is directed to a molded, plastic closure exhibiting enhanced column strength, wherein a plurality of vertically-oriented, strengthening ribs are provided on an inside surface of the lower skirt portion of the closure. In the preferred form, the configuration of the strengthening ribs is formed to provide respective alignment with exterior grooves which define exterior gripping knurls on the skirt portion. By this arrangement, the closure desirably exhibits sufficient strength as to permit efficient formation by "stripping" from an associated core pin, thus facilitating efficient and cost-effective formation and use.

In accordance with the illustrated embodiment, the present plastic closure includes a circular top wall portion, and an annular skirt portion depending from the skirt wall portion, with the skirt portion having an internal thread formation. The thread formation is configured for cooperative engagement with a like, external thread formation on an associated container.

In accordance with the present invention, the skirt portion defines an array of alternating, circumferentially spaced grooves and lands, which together define a plurality of circumferentially spaced, vertically extending strengthening ribs on an inside surface of the skirt portion. The strengthening ribs are positioned on the inside surface of the skirt portion beneath the thread formation, with the grooves at the inside surface preferably being open at a free edge of the skirt portion.

In the preferred form, the skirt portion of the closure defines a plurality of circumferentially spaced, gripping knurls on an exterior surface thereof. Notably, the gripping knurls are respectively aligned with the circumferentially spaced grooves defined by the interior surface of the skirt portion. By this arrangement of the exterior knurls, and strengthening ribs defined by the interior grooves, the column strength of the skirt portion of the closure is desirably enhanced, facilitating efficient molding by permitting "stripping" of the closure form an associated core pin.

In accordance with the illustrated embodiment, the interior grooves are generally semi-cylindrical in configuration, and have a circumferential dimension greater than a circumferential dimension of each of the associated lands.

In the illustrated embodiment, the skirt portion of the closure includes a relatively thick, annular bead portion at a free edge thereof. The annular bead defines an annular, ejection surface at the free edge of the skirt portion, with the gripping knurls on the exterior of the skirt portion preferably extending upwardly from the annular bead.

Other features and advantages of the present invention will become readily apparent from the following detailed description, the accompanying drawings, and the appended claims.

DETAILED DESCRIPTION

Figure 1:
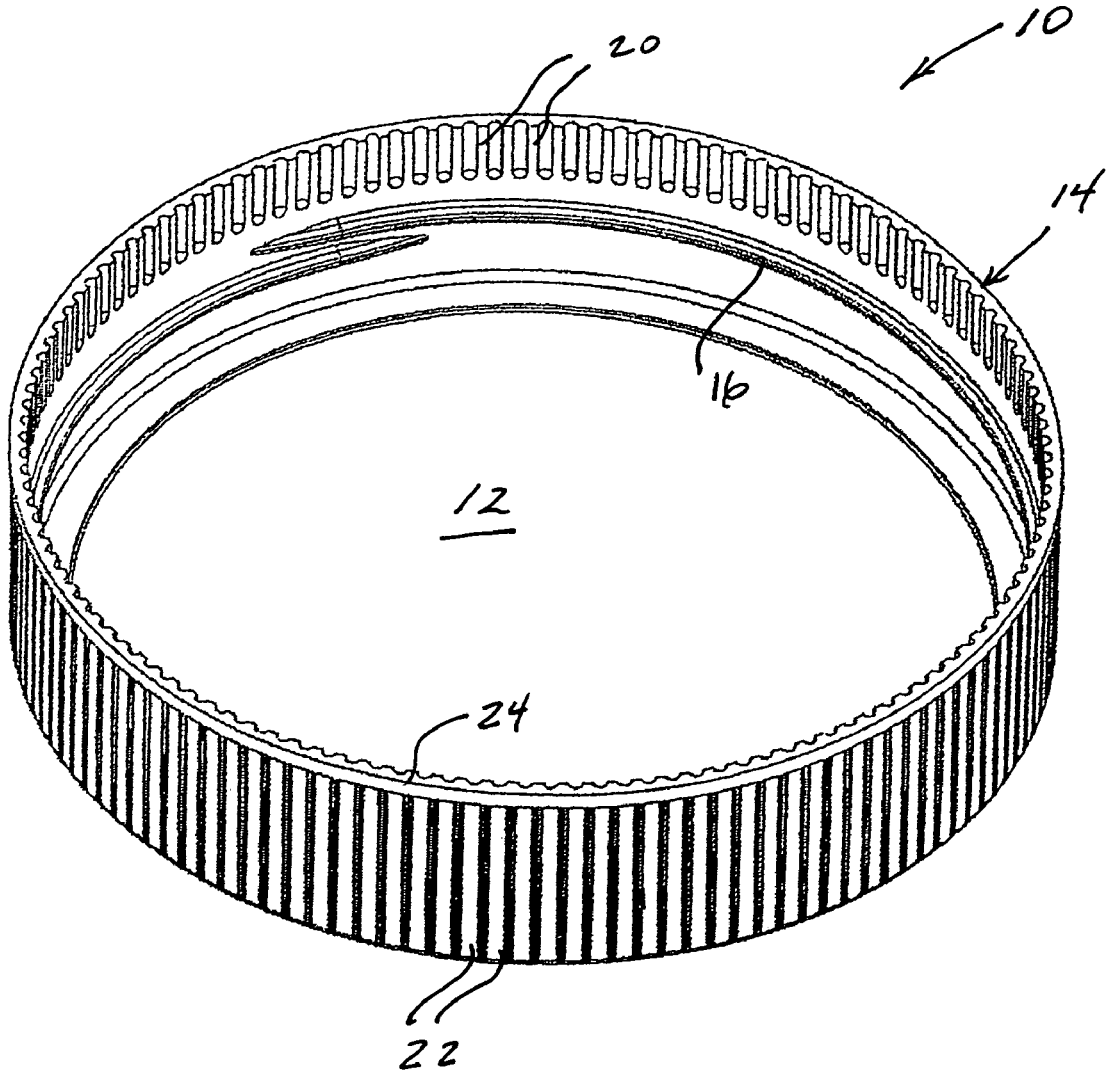
FIG. 1 is a perspective view of a molded plastic closure embodying the principles of the present invention, illustrating the interior thereof.
Figure 2:
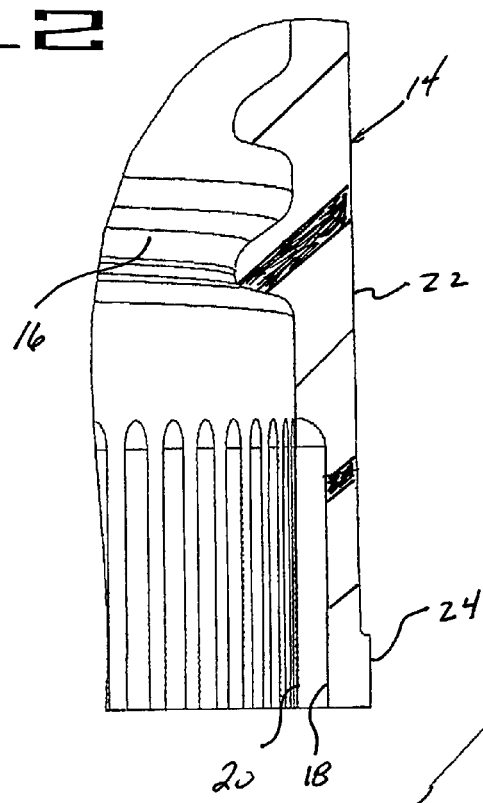
FIG. 2 is a fragmentary, cross-sectional view of a skirt portion of the closure illustrated in FIG. 1.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference to the drawings, therein is illustrated a molded plastic closure 10 embodying the principles of the present invention. As will be known by those skilled in the art, plastic closure 10 can be efficiently formed from polymeric materials, such as polypropylene or polyethylene, and can be formed by injection molding or compression molding. Notably, closure 10 can be configured to exhibit a relatively large diameter, such as on the order of 63 millimeter to 110 millimeters. However, a closure keeping with the principles disclosed herein can be otherwise sized.

To facilitate the desired closing of an associated container, closure 10 includes a circular, top wall portion 12, and an annular skirt portion 14 depending from the top wall portion. For some applications, closure 10 can be provided with a suitable, separate sealing liner element (not shown).

Skirt portion 14 includes a helical, internal thread formation 16, which is configured for engagement with a like, external thread formation on an associated container. By this arrangement, relative rotational movement of the closure with respect to the container effects application and removal.

In accordance with the present invention, skirt portion 14 is of a configuration which is desirably lightened, conserving plastic material, while exhibiting the requisite strength to facilitate efficient closure formation. To this end, the interior surface of skirt portion 14 defines an array of alternating, circumferentially spaced grooves 18, and associated lands, which together define a plurality of circumferentially spaced strengthening ribs 20 on the inside surface of the skirt portion. In accordance with the preferred form, strengthening ribs 20 are vertically oriented, and generally parallel to a vertical axis of the closure 10.

In accordance with a presently preferred form, each of grooves 18 has a circumferential dimension greater than a circumferential dimension of each of the associated lands separating adjacent ones of the grooves 18. Each of grooves 18 preferably has a generally semi-cylindrical configuration, with each of the grooves preferably being open at a lower, free edge of skirt portion 14.

Figure 3:
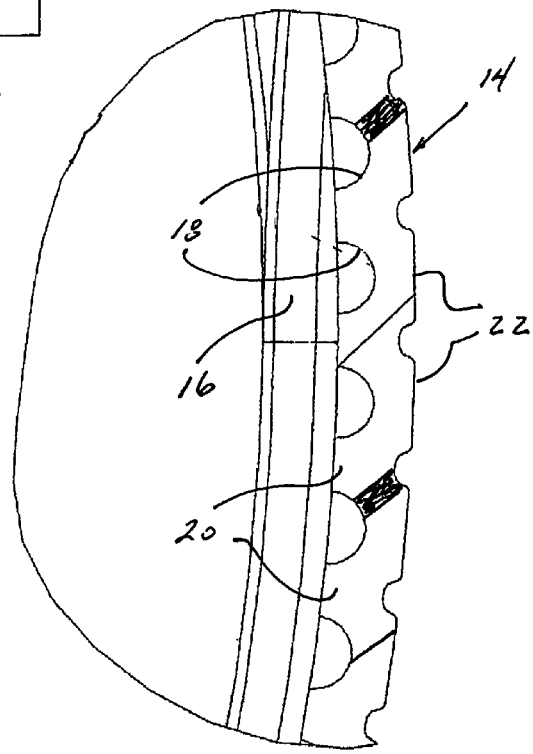
FIG. 3 is a further fragmentary, cross-sectional view showing a circumferential portion of the skirt portion of the closure of FIG. 1.

The desired column strength of the closure 10 is further enhanced by the provision of a plurality of circumferentially spaced, gripping knurls 22 provided on an exterior surface of the skirt portion. As illustrated in FIG. 3, the gripping knurls 22 are preferably respectively aligned with the circumferentially spaced grooves 18 defined by the interior surface of the skirt portion. This specific arrangement of the interior grooves 18, and thus strengthening ribs 20, and the exterior knurls 22 provide the desired strength characteristics in the skit portion of the closure, while providing the desired exterior gripping surface to facilitate removal and application of the closure by consumers.

In the preferred form, the skirt portion 14 of closure 10 includes a relatively thick, annular bead portion 24 at a free edge of the skirt portion. Bead portion 24 defines a lower ejection surface against which force can be applied for effecting "stripping" of the molded closure 10 from an associated core pin during formation. As illustrated, exterior gripping knurls 22 preferably extend upwardly from annular bead portion 24.

From the foregoing, it will be apparent that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A molded, plastic closure exhibiting enhanced column strength, comprising:

a top wall portion; and an annular skirt portion depending from said top wall portion, said skirt portion including an internal thread formation, said skirt portion defining an array of alternating, circumferentially spaced grooves and lands which together define a plurality of circumferentially spaced strengthening ribs on an inside surface of said skirt portion, to thereby enhance the column strength of said closure, said circumferentially spaced grooves extending beneath and being spaced from said internal thread formation, each of said grooves having a circumferential dimension greater than a circumferential dimension of each of said lands, said skirt portion of said closure defining a plurality of circumferentially spaced gripping knurls on an exterior surface thereof, wherein said gripping knurls are respectively aligned with said circumferentially spaced grooves defined by the interior surface of said skirt portion.

2. A molded, plastic closure in accordance with claim 1, wherein:

said strengthening ribs are vertically oriented and generally parallel a vertical axis of said closure.

3. A molded, plastic closure in accordance with claim 1, wherein:

each of said grooves has a generally semi-cylindrical configuration.

4. A molded, plastic closure in accordance with claim 1, wherein:

each of said grooves is open at a free edge of said skirt portion.

5. A molded, plastic closure in accordance with claim 1, wherein:

said skirt portion includes a relatively thick, annular bead portion at a free edge thereof, said gripping knurls extending upwardly from said annular bead portion.

6. A molded, plastic closure, comprising:

a top wall portion; and an annular skirt portion depending from said top wall portion, said skirt portion having an internal thread formation, said skirt portion defining an array of alternating, circumferentially spaced grooves and lands which together define a plurality of circumferentially spaced, vertically extending, strengthening ribs on an inside surface of said skirt portion extending beneath and spaced from said thread formation, each of said grooves being open at a free edge of said skirt portion, said skirt portion of said closure defining a plurality of circumferentially spaced gripping knurls on an exterior surface thereof, said gripping knurls being respectively aligned with said circumferentially spaced grooves defined by the interior surface of said skirt portion, wherein each of said grooves has a circumferential dimension greater than a circumferential dimension of each of said lands.

7. A molded, plastic closure in accordance with claim 6, wherein:

said skirt portion includes a relatively thick, annular bead portion at a free edge thereof, said gripping knurls extending upwardly from said annular bead portion.

* * * * *